US005322407A

United States Patent [19]

Reck et al.

[11] Patent Number: 5,322,407

[45] Date of Patent: Jun. 21, 1994

[54] EQUIPMENT FOR EMPTYING CONTAINERS

[75] Inventors: Herbert Reck, Main; Rolf Saftig, Plaidt, both of Fed. Rep. of Germany

[73] Assignee: Zoller-Kipper GmbH, Mainz, Fed. Rep. of Germany

[21] Appl. No.: 936,259

[22] Filed: Aug. 27, 1992

[30] Foreign Application Priority Data

Aug. 30, 1991 [DE] Fed. Rep. of Germany ..... 4128955

[51] Int. Cl.[5] ..... B65F 3/02

[52] U.S. Cl. ..... 414/406; 414/408; 414/421; 414/539; 414/730

[58] Field of Search ..... 414/406, 408, 404, 419–421, 414/425, 539–540, 555, 730

[56] References Cited

U.S. PATENT DOCUMENTS

| | | | |
|---|---|---|---|
| 4,305,693 | 12/1981 | Naab | 414/408 X |
| 4,479,751 | 10/1984 | Wyman et al. | 414/420 X |
| 4,722,656 | 2/1988 | Naab | 414/421 X |
| 4,722,658 | 2/1988 | Würtz et al. | 414/421 X |
| 5,006,030 | 4/1991 | Smith et al. | 414/408 X |
| 5,062,759 | 11/1991 | Pieperhoff | 414/408 |
| 5,064,333 | 11/1991 | Würtz | 414/408 |

FOREIGN PATENT DOCUMENTS

| | | | |
|---|---|---|---|
| 3517491 | 11/1986 | Fed. Rep. of Germany | 414/408 |
| 3910660 | 10/1990 | Fed. Rep. of Germany . | |
| 8903794 | 5/1989 | PCT Int'l Appl. . | |
| 8503689 | 8/1985 | World Int. Prop. O. | 414/408 |

*Primary Examiner*—Michael S. Huppert
*Assistant Examiner*—James Keenan
*Attorney, Agent, or Firm*—H. Gibner Lehmann; K. Gibner Lehmann

[57] ABSTRACT

In order to make it possible to empty in particular, large containers with a crew of just one person, an emptying device with a tilting/lifting device 1 and a control unit 4 is described to which a trigger switch 2 is connected which is actuated by the container to be emptied as it approaches the lifting/tilting device and which triggers the raising phase of the lifting/tilting process automatically. When a preset raised level of the lifting/tilting device is reached the control unit interrupts the raising phase. In addition, a first manual actuator 8 to trigger the automatic emptying process, which actuator has an effect upon the control unit 4 only after the interruption of the lifting process, is connected to the control unit. The control unit 4 contains a programmable device 5 into which the preset raised level can be inputted. The programmable device 5 also assumes the function of monitoring the preset time spans, such as the time span between the actuation of the trigger switch 2 and the actuation of the acknowledgement signal switch 3. After the container is emptied, putting the container back down completely is accomplished by means of a second manual actuator 9.

19 Claims, 4 Drawing Sheets

EQUIPMENT FOR EMPTYING CONTAINERS

Figure 1:
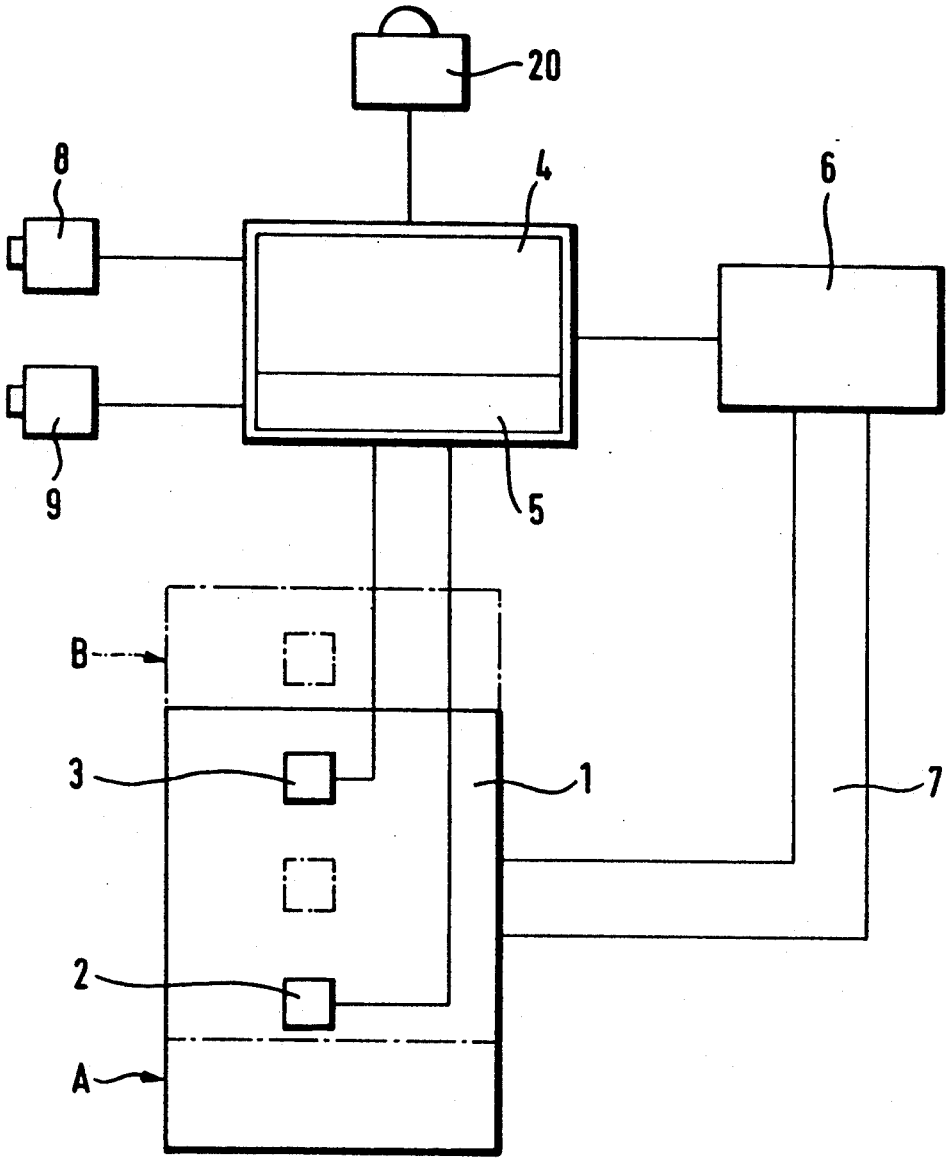

This invention relates to a device for emptying containers, in particular garbage containers, into collecting bins with at least one tilting or lifting/tilting device having a gripping device to grip the garbage container, and with a pressurized drive mechanism which controls the tilting or lifting/tilting process, there being attached to the gripping device at least one acknowledgement signal switch to monitor and signal to the control unit the correct seating of the garbage container in the gripping device.

Lifting/tilting devices having various different control units are known for emptying garbage containers. For small garbage containers such as those of 240 liter capacity, automatic controls are known by means of which the garbage container, after having been gripped by the lifting/tilting device, ia emptied and put back on the ground fully automatically. Such a fully automatic emptying device is known from DE-OS 3,910,660, for example. In order to largely prevent manipulations on the part of the operating personnel, there are provided on the lifting/tilting device, flap and acknowledgement signal switches, among others, connected to a current flow monitor which constantly checks the planned switching status of these switches and sends a clear signal to the automatic control only if the switches, at the planned moment in time, are switched in the intended manner. Despite these safety measures, such fully automatic emptying devices cannot be used for emptying large garbage containers such as those of 1.1 $m^3$ capacity because additional safety measures must be taken on account of the great weight of the containers. In these instances, it is especially the exact gripping of the garbage container by the gripping device of the lifting/tilting device which plays an important role because, under circumstances, a large container, not seated properly, can fall down more easily than a small one during the fully automatic emptying process so that the operating personnel is possibly exposed to a greater danger. Consequently, additional safety checks by the operating personnel must be provided.

In order to bring the entire emptying process under the control of the operating personnel, large containers have heretofore been emptied manually only. The operator must first position the garbage container in the gripping device, whereupon he actuates a lever capable of controlling and influencing the entire emptying process. But this entails the disadvantage that the time consumed by the emptying operation cannot be utilized to get the next container.

Besides manual emptying, lifting/tilting devices with a semi-automatic control are also known. Such a lifting-/tilting device is described, for instance, in WO 89/03794 for emptying small garbage containers. The garbage container to be emptied is brought close to the lifting/tilting device and first held there by the operator. Then, by pushing a button, a second operator raises the lifting/tilting device until it grips the garbage container rim. This actuates a switch provided at the lifting-/tilting device, which switch serves to monitor the correct seating of the container. If the switch is actuated as specified, the lifting/tilting process is continued and the container emptied automatically. The disadvantage of this lifting/tilting device is the fact that one person must first hold the garbage container—e.g. on a downhill street until a second operator can raise the lifting-/tilting device into gripping position. In addition, since the sequence of motions continues Without interruption if the container is properly seated, the operator may be injured under circumstances if he does not let go of the container at the correct moment.

Known from DE-OS 3,517,491 is a lifting/tilting device for emptying garbage containers in which the lifting/tilting device is first raised manually and the automatic control of the directional control valve for lifting, holding or lowering is automatically triggered only after a certain lifting height or lifting time. The automatic emptying process is triggered by a motion indicator mounted at a preset lifting height. A switch mounted in the seating area of the lifting/tilting device and actuated by the garbage container rim may also be provided, with the time-delayed initiation of the automatic emptying process being secured by a timer. Again, when raising the lifting/tilting device manually, a second operator must be present. Since the automatic emptying process is triggered e.g. by the garbage container, it is not possible for the operating personnel to check the correct seating of the garbage container first. Interrupting the emptying process is possible only by actuation of the emergency stop switch.

Therefore, the object of the present invention is a tilting or lifting/tilting device Which requires only one operator and which can determine by itself the time of the start of the automatic emptying process after the container has been gripped by the gripping device and after an additional optical check that the container is seated properly.

This problem is solved by a device according to the characteristic features of claim 1. Advantageous embodiments are the subject of the sub-claims.

According to the invention, the raising phase is understood to mean the raising of the lifting/tilting device from its lowest position up to a certain, preset, raised level at which the container to be emptied is completely accepted by the gripping device and has been lifted off the ground. It is sufficient for the container, after interruption of the raising phase, to be just a few centimeters off the ground.

The invention is based on the realization that the raising phase is put into motion automatically by the container, but that this raising phase is subsequently interrupted and the ensuing emptying process is started manually.

To carry out this semi-automatic emptying process the tilting or lifting/tilting device contains at least one trigger switch actuatable by the garbage container when it is brought to the tilting or lifting/tilting device. This trigger switch may be a flag switch actuated by the container wall as the garbage container is brought to the lifting/tilting device. It is also possible within the scope of the invention to provide a light barrier, for instance, also triggered by the garbage container when it touches the lifting/tilting device. Such trigger switches are known per se from automatically working lifting/tilting devices, such trigger switches then triggering the entire lifting/tilting process, however.

In semi-automatically working emptying devices these trigger switches are not known, however, because the raising phase has so far been carried out by manual actuation. The automatic starting of the raising phase only by an action of the approaching container to be emptied offers the advantage that only one operator is needed. This operator is not endangered by the automation of the raising phase because the container is raised only a short distance. Even if the container has been gripped properly and has detached itself from the gripping device, it would hit the ground undamaged at a raised level of only a few centimeters.

After the tilting or lifting/tiling device has reached the preset raised level, this raising phase is interrupted by the control unit. This offers the advantage that the operator, especially when large containers are involved, has another opportunity to check the correct seating of the garbage container on or in the gripping device. While at least one acknowledgement signal switch is provided which is disposed, for instance, in the area of the receiving arms and triggered by the container rim, thus checking the correct seating of the container, it is nevertheless still possible for cases to occur in which the acknowledgement switch or the acknowledgement signal switches are triggered all right, yet the container has perhaps still not assumed its optimal seat in the gripping device. Thus, the operator is given another opportunity to make a correction in this regard.

This is impossible in the devices according to the state of the art because, after the manually performed raising phase, the subsequent emptying process is triggered automatically, be it by means of a motion indicator or a trigger switch in the area of the gripping device.

Because, according to the invention, the subsequent emptying process is not started automatically, the operator must move away from the garbage container and trigger the first manual actuator which is preferably mounted on the side of the garbage truck or on the lifting/tilting device in order to start the automatic emptying process. This precludes the endangerment of the operator because he is no longer located in the swivel range of the container when triggering the automatic emptying process.

Interrupting the raising phase through the control unit can be realized in different ways. Preferably, the control unit comprises a programmable device into which the desired raised level can be inputted. The possibility also exists to design the control program so that the raising phase is interrupted at a desired point in time or at a desired raised level.

According to another embodiment, at least one raise limit switch connected to the control unit is provided. Such a raise limit switch may either be a proximity switch, a light barrier, a cam switch or an angle of rotation transmitter, said raise limit switch being triggered by the tilting or lifting/tilting device at a preset raised level. The raise limit switch then transmits an appropriate signal to the control unit, whereupon the latter interrupts the raising phase. This raise limit switch is mounted to a fixed garbage truck part at the level corresponding to the preset raised level.

Another embodiment provides for the control unit to contain a timer which transmits a signal to interrupt the raising phase after a preset time has elapsed. This timer is started by the trigger switch, the preset time being harmonized with the raising speed of the lifting/tilting device.

To increase the operating personnel's safety even more it is provided in a special embodiment that the control unit be designed to monitor a preset first time span between the actuation of the trigger switch and the actuation of the acknowledgement signal switch. If the raising phase proceeds smoothly, a certain time span is always maintained between the actuation of these two switches, controlled by the raising speed of the lifting-/tilting device. Should problems arise during the raising phase, e.g. in that the container rim is not properly gripped by the receiving arms and the container might possibly assume its correct position only at a time later than intended, this irregularity is recognized by the control unit on account of the excess time lapse. In such a case, the lifting/tilting device is stopped immediately and/or the operator is informed acoustically and/or by an optical display that this raising phase has not proceeded faultlessly which, in turn, is an indication for the operator to recheck once more that the container is properly seated.

According to a special embodiment, this first time span may be monitored by the programmable device into which the predetermined time span can be inputted.

According to another embodiment there may also be connected to the control unit a separate monitor which transmits a clear signal to the control unit only when the preset first time span between the actuation of the trigger switch and the actuation of the acknowledgement signal switch is maintained. At the usual raising speeds, the first time span is preferably less than 2 seconds.

In garbage trucks with two individual lifting/tilting devices for the emptying of smaller containers the possibility exists, by appropriately designing the receiving arms, to also empty large containers which are gripped by the gripping devices of both lifting/tilting devices. Each one of the individual lifting/tilting devices has its own trigger switch which is actuated by small containers when they are being emptied. If it is intended to empty a large container by employing both individual lifting/tilting devices, these trigger switches are usually not being actuated at the same time when a large container is being loaded. But, since the trigger switch of the respective lifting/tilting device triggers the raising phase when being actuated, it may happen that one lifting/tilting device already performs the raising phase while the other individual tilting/lifting device still remains in its starting position. In such a case the container might be raised on one side already while still staying on the ground on the other side so that the container assumes a lopsided position which, when the second individual tilting/lifting device goes into action, leads to incorrect seating in the gripping device, thus not assuring that the emptying process will proceed without trouble.

It is consequently provided according to the invention that the control unit is designed to monitor a preset second time span between the actuation of at least two trigger switches. Only if the trigger switches are actuated within a preset time span may it be assumed that the container is in its correct starting position in the lifting/tilting devices. If the preset second time span is maintained, the raising process is started by the control unit after the actuation of the last trigger switch. If the preset second time span is not maintained, the raising phase of the lifting/tilting device, although its trigger switch has already been actuated, is not being triggered either. Both lifting/tiltting devices will then remain in their starting positions. In addition, an optical feature may inform the operator that problems have arisen with respect to the loading of the garbage container. Nor does the monitoring of the preset first and second time spans permit manipulations on the part of the operating personnel. For example, if one of the trigger switches or acknowledgement signal switches becomes active or is arrested by hand first, the preset time spans can no longer be kept, which leads to the above described interruption of the entire lifting process.

This second time span, too, may be inputtable into the programmable device, or else the programmable device may be designed so as to monitor this second time span.

According to another embodiment, a second monitor connected to the control unit may be provided to transmit a clear signal to the control unit only if the preset second time span has been maintained between the actuation of at least two trigger switches. This second time span is preferably in the range from 0.4 to 0.8 sec. It is also possible within the scope of the invention to integrate the first and the second monitor.

Putting the container down completely and releasing it from the gripping device after completion of the emptying process may lead to the container rolling away on an inclined street. To prevent this, the control unit is designed so that the lowering of the garbage container is interrupted at a preset reference level and that a second manual actuating device is provided by means of which the complete lowering of the container is controllable manually. This reference level may correspond to the preset raised level of the raising phase. Again, the raise limit switch may be actuated at the preset reference level, thus performing a second function. Accordingly, the complete lowering of the container is under the operating personnel's control.

Exemplary embodiments of the invention are explained below in greater detail with reference to the drawings.

Figure 2:
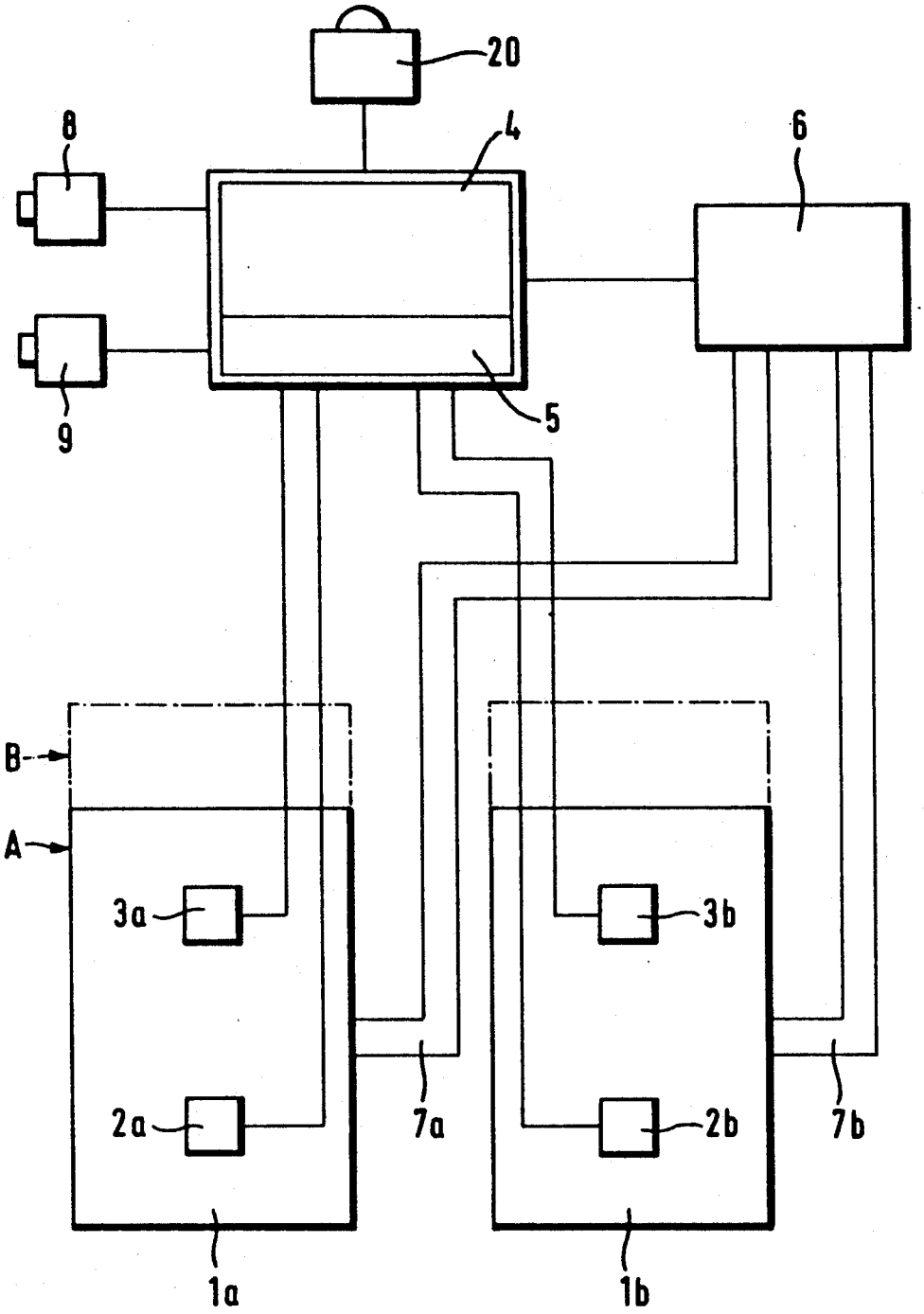
Figure 3:
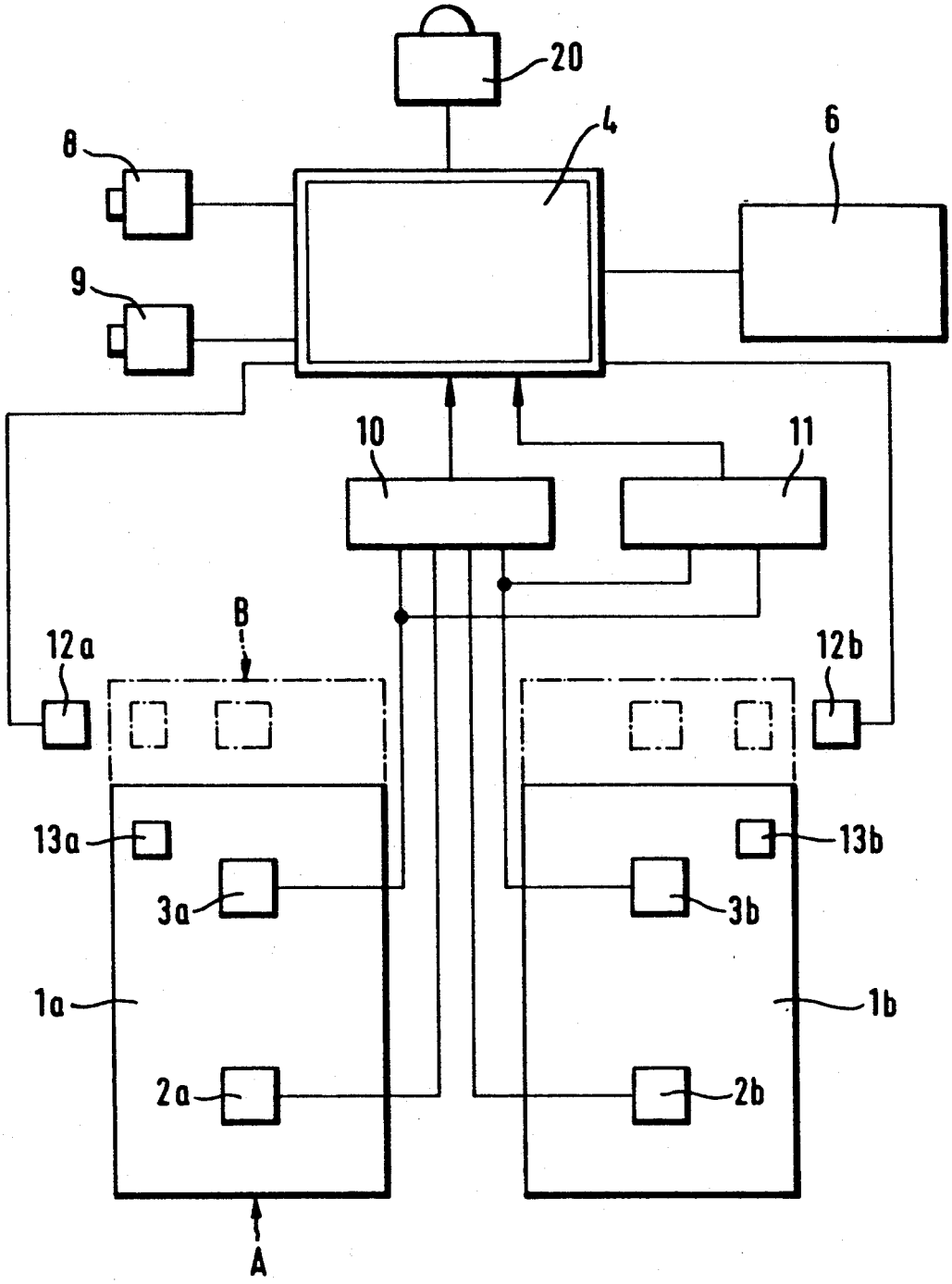
Figure 4:
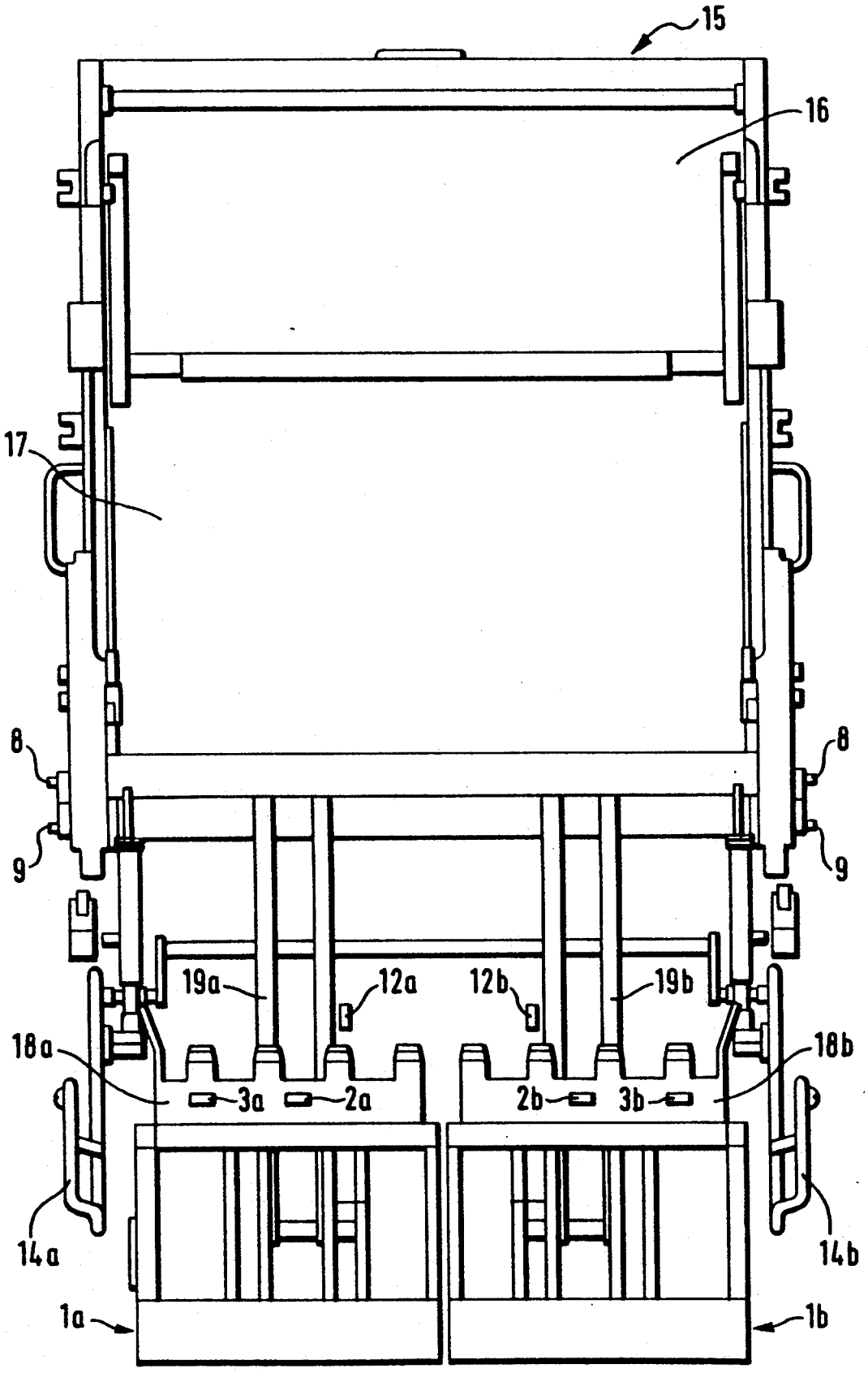

FIG. 1 shows the schematic of the system with one lifting/tilting device,

FIG. 2 the schematic of the system with two lifting-/tilting devices according to first embodiment, FIG. 3 the schematic of the system with two lifting-/tilting devices according to a further embodiment, and FIG. 4 the rear view of a garbage truck with a system according to FIG. 3, Shown schematically in FIG. 1 is a device for emptying containers which contains a single lifting/tilting device 1. This lifting/tilting device 1 has, in known manner, pressurizing motors connected to an hydraulic circuit and a pressurizing pump. This hydraulic drive system and its connection to the lifting/tilting device 1 are indicated by the reference symbols 6 to 7.

The tilting/lifting device 1 is equipped with a trigger switch 2 and an acknowledgement signal switch 8. The trigger switch 2 is actuated when the garbage container (not shown) approaches, thereby transmitting a signal to the control unit 4 which contains a programmable device 5. After the actuation of the trigger switch 2 by the container to be emptied, the control unit 4 sends a corresponding signal to one or several elements of the hydraulic drive system 6 so that the lifting/tilting device 1 is moved out of its starting position A upwardly until the preset raised level characterized by the position B is reached.

During this raising phase from the position A into the position B. the container to be emptied is gripped by the gripping device, the container rim, for instance, actuating the acknowledgement signal switch 3 in the process. In the case shown here, the preset raised level is programmed into the programmable device 5 which transmits, at a certain point in time, a corresponding signal to the hydraulic drive system 8 which then stops the hydraulic motors (not shown) of the lifting/tilting device 1.

In the embodiment shown here, the programmable device 5 also assumes the time monitoring function of the time span between the actuation of the trigger switch 2 and the actuation of the acknowledgement signal switch 3. If the first time span, put into the programmable device 5, is not kept, the control unit will send an appropriate signal to the hydraulic drive system 8 which then stops the tilting/lifting device 1. In addition, the control unit 5 may also light a warning lamp 20 to indicate to the operating personnel that irregularities have arisen during the raising phase.

Connected to the control device 5 is a manual actuator 8 by means of which the operator can trigger the automatic emptying process after having checked that the garbage container is properly seated in the gripping device of the lifting/tilting device 1. The control unit 4 will then send a corresponding signal to the hydraulic drive system 6, whereupon the lifting/tilting device will leave the position B and, depending on the mechanical design of the tilting or lifting/tilting device 1, lift the container further and then tip it into the pour-in opening. In the emptying position of the lifting/tilting device there may also be provided a shaking operation or a dwell of the garbage container, the kind of motion sequence being controlled by the control unit 4 through appropriate signals to the hydraulic drive system 6.

After completion of the emptying process, the container is swung back and lowered, the lifting/tilting device 1 being stopped at a preset reference level which may correspond to position B. By actuating a second manual actuator 9 which is likewise connected to the control unit 4, the operator can effect the complete lowering of the lifting/tilting device 1 and thus of the container.

Shown schematically in FIG. 2 is a container emptying system comprised of two individual lifting/tilting devices 1*a* and 1*b*. This FIG. again shows the hydraulic drive system 6 only schematically, and the connection between the hydraulic drive system 8 and the lifting-/tilting devices is indicated schematically by the connecting lines 7*a* and 7*b*. Each one of the lifting/tilting devices 1*a* and 1*b* has a trigger switch 2*a*, 2*b* and an acknowledgement signal switch 3*a* and 3*b*. In this embodiment also, the control unit 4 contains a programmable device 5. Likewise, a first manual actuator 8 and a second manual actuator 9 are connected to the control unit 4. The operating mode of the system when emptying a large container, emptied jointly by the two individual lifting/tilting devices 1*a* and 1*b*, is described in the following. Upon the approach of the large container, the two trigger switches 2*a*, 2*b* are actuated by the container wall more or less at the same time. The programmable device 5 assumes the monitoring function of the second time span between the actuation of the two trigger switches 2*a* and 2*b*. If the preset time span between the actuation of these two trigger switches is exceeded, none of the two individual lifting-/tilting devices 1*a* and 1*b* will be raised. Both individual lifting/tilting devices will then remain in their starting position A. In this case also, the optical display 20 may be lit up by the control unit 4 to inform the operator that this second time span was not maintained and that irregularities must therefore be expected.

However, if the preset time span between the actuation of the two trigger switches 2*a* and 2*b* is maintained, the two individual tilting/lifting devices 1*a* and 1*b* are raised. This may occur independently of each other. Before position B is reached, the acknowledgement signal switches 3a, 3b are actuated by the container rim, possibly one after the other. In addition, the time span between the actuation of the trigger switch 2a and the acknowledgement signal switch 3a, respectively between the actuation of the trigger switch 2b and the acknowledgement signal 3b, is monitored in the process. If this first time span was also kept for both individual lifting/tilting devices 1a and 1b, the operator can trigger the automatic emptying process via the first manual actuator 8, causing both individual lifting/tilting devices to empty the large container jointly. The second manual actuator 9 serves, in this embodiment also, the purpose of lowering both individual lifting/tilting devices completely after the container was emptied.

FIG. 3 illustrates another embodiment in which, replacing the programmable device 5, a first monitor 10 and a second monitor 11 are now provided between the trigger switches 2a and 2b, the acknowledgement signal switches 3a and 3b, and the control unit 4. Monitoring the first time span is now assumed by the first monitor 10 and monitoring the second time span by the second monitor 11, both monitors transmitting respective clear signals to the control unit 4 if the preset time spans were kept, which signals in turn actuate the hydraulic drive system 6. The connection between the hydraulic drive system 6 to the individual lifting/tilting devices 1a and 1b is not shown.

Disposed in the area of position B and lateral to the two individual lifting/tilting devices 1a and 1b is a raise limit switch 12a and 12b, respectively, which may be designed as proximity switch. Correspondingly, the individual tilting/lifting devices 1a and 1b have contact elements 13a and 13b which actuate the switches 12a and 12b when position B is reached. These raise limit switches 12a and 12b are connected to the control unit 4 which, in the presence of the appropriate signals, causes the hydraulic drive system 6 to stop the individual lifting/tilting devices 1a and 1b.

FIG. 4 shows the rear view of a garbage truck 15. The individual lifting/tilting devices 1a and 1b have gripping devices in the form of receiving arms 18a and 18b, designed to accept large containers also. Disposed at the front of these gripping devices 18a and 18b is a trigger switch 2a and 2b, respectively. Mounted behind the gripping devices are acknowledgement signal switches 3a and 3b, actuated by the container rim when the container is seated in the gripping devices 18a and 18b. These lifting/tilting devices 1a and 1b are actuated by means of swivel arms 19a and 19b connected to the hydraulic drive system 6 which is invisible in the representation shown here.

Fastened to the garbage truck 15 are raise limit switches 12a and 12b which are actuated at the preset raised level (position B) by the swiveling of the swivel arms 19a and 19b, leading to an interruption of the raising phase. The lateral area of the two lifting/tilting devices is secured by two barriers 14a and 14b. Shown on the side of the garbage truck 15 are the first manual actuator 8 and the second manual actuator 9, designed as button switches. By pushing the first manual actuator 8, which becomes effective only after position B has been reached and no irregularity has been reported, the automatic emptying process is started, during which the garbage container to be emptied is tipped into the pour-in opening of the pour-in housing 16. After the garbage container is emptied, lowering it completely and depositing it on the street is accomplished with the help of the second manual actuator 9.

What is claimed is:

1. Equipment for emptying garbage containers into collecting bins, said equipment having a lifting/tilting mechanism (1) which is provided with a gripping device (18) to correctly grip a garbage container which is resting on the ground, and provided with a pressurized drive means (19) and further provided with an electrical control unit (4) that controls the movement of the lifting/tilting mechanism in a raising phase, followed by an emptying phase, there being attached to the gripping device (18) an acknowledgement signal switch (3) which monitors and which signals to the control unit (4) that the garbage container has been correctly gripped, characterized in that: a trigger switch (2) is provided, which is actuatable by the garbage container as the garbage container approaches the lifting/tilting mechanism (1), said trigger switch (2) being connected to the control unit (4) and said trigger switch (2) being adapted to automatically trigger the raising phase of the lifting/tilting mechanism's movement; in that the control unit (4) is adapted to automatically interrupt the said raising phase of the lifting/tilting mechanism's movement upon the mechanism reaching a predetermined raised level which is above the ground and at which level the container to be emptied is gripped by the gripping device (18); and in that there is connected to the control unit (4) a manual actuator means (8) to override the said interruption in the raising phase, and to automatically thereafter initiate resumption of the said raising phase and the emptying phase, said manual actuator means (8) triggering the control unit (4) only after the said interruption of the raising phase has occurred and has been overriden by the manual actuator means (8).

2. Equipment according to claim 1, characterized in that the control unit (4) contains a programmable device (5) for setting the said predetermined raised level above the ground.

3. Equipment according to claim 2, characterized in that the control unit (4) monitors a preset time span between the actuation of the trigger switch (2) and the actuation of the acknowledgement signal switch (3), and the preset time span is fed into the programmable device (5).

4. Equipment according to claim 2, characterized in that two trigger switches (2a, 2b) are provided, which are connected to the control unit (4).

5. Equipment according to claim 4, characterized in that the control unit (4) monitors a preset time span between the actuation of the two trigger switches (2a, 2b).

6. Equipment according to claim 5, characterized in that the preset time span between the actuation of the two trigger switches (2a, 2b) is fed into and stored by the programmable device (5).

7. Equipment according to claim 5, characterized in that the said time span is between 0.4 and 0.8 seconds.

8. Equipment according to claim 1, characterized in that there is provided and connected to the control unit (4) a raise limit switch (12) which is actuatable by the lifting/tilting mechanism (1) and which transmits a signal to the control unit (4) when the lifting/tilting mechanism reaches the predetermined raised level.

9. Equipment according to claim 1, characterized in that the control unit (4) contains a timer which transmits a signal to interrupt the raising phase after a preset time has elapsed.

10. Equipment according to claim 1, characterized in that the control unit (4) monitors a preset time span between the actuation of the trigger switch (2) and the actuation of the acknowledgement signal switch (3).

11. Equipment according to claim 10, characterized in that the time span is less than two seconds.

12. Equipment according to claim 1, characterized in that there is connected to the control unit (4) a monitor (10) which sends a clear signal to the control unit (4) only if a preset time span has been maintained between the actuation of the trigger switch (2) and the actuation of the acknowledgement signal switch (3).

13. Equipment according to claim 2, characterized in that two trigger switches (*2a*, *2b*) are provided, which are connected to the control unit (4), and there is provided a second monitor which sends a clear signal to the control unit (4) only if a preset time span has been maintained between the actuation of the two trigger switches (*2a*, *2b*).

14. Equipment according to claim 1, characterized in that there is provided a second lifting/tilting mechanism, said first-mentioned lifting/tilting mechanism and said second lifting/tilting mechanism being juxtaposed to one another, and two trigger switches (*2a*, *2b*) are provided, which are connected to the control unit (4), the two trigger switches being respectively mounted on said lifting/tilting mechanisms, and there are further provided two raise limit switches (*12a*, *12b*) which when actuated, each transmit an independent signal to the control unit (4) to indicate that the respective lifting/tilting mechanism has reached said predetermined raised level, and to interrupt the movement of the respective lifting/tilting mechanism.

15. Equipment according to claim 1, characterized in that following the raising phase movement and the emptying phase movement, there occurs a lowering phase movement of the lifting/tilting mechanism, the control device (4) interrupting the lowering phase movement of the lifting/tilting mechanism at a preset reference level, and in that a second manual actuator means (9) is provided, to override the said interruption of the lowering phase movement of the lifting/tilting mechanism and to thus initiate resumption of the said lowering phase to thereby return the garbage container to the ground.

16. Equipment according to claim 1, characterized in that there is provided a raise limit switch (12) which is actuated when the said predetermined raised level of the lifting/tilting mechanism has been reached.

17. Equipment according to claim 1, characterized in that the control unit (4) automatically interrupts the raising phase of the lifting/tilting mechanism's movement regardless of whether the acknowledgement signal switch has been actuated by the container.

18. Equipment according to claim 1, characterized in that the control unit (4) automatically interrupts the raising phase of the lifting/tilting mechanism's movement even if the container has been correctly positioned on the lifting/tilting mechanism.

19. Equipment according to claim 1, characterized in that the manual actuator means (8) is disposed to one side of the lifting/tilting mechanism, so as to minimize danger to personnel in the event that the container slips off the lifting/tilting mechanism as the operator is manually resuming the raising phase of the mechanism.

* * * * *